US005858030A

United States Patent [19]

Waller et al.

[11] Patent Number: 5,858,030

[45] Date of Patent: Jan. 12, 1999

[54] DIESEL FUEL COMPOSITION COMPRISING DIALKOXY ALKANES FOR INCREASED CETANE NUMBER

[75] Inventors: Francis J. Waller, Allentown; Edward L. Weist, Jr., Macungie, both of Pa.; Dennis M. Brown, East Molesey, England; Petrus J. A. Tijm, Center Valley, Pa.

[73] Assignee: Air Products and Chemicals, Inc., Allentown, Pa.

[21] Appl. No.: 935,430

[22] Filed: Sep. 23, 1997

[51] Int. Cl.[6] ..... C10L 1/18

[52] U.S. Cl. ..... 44/448; 44/443

[58] Field of Search ..... 44/443, 448

[56] References Cited

U.S. PATENT DOCUMENTS

| | | |
|---|---|---|
| 3,504,140 | 3/1970 | Badin . |
| 3,594,136 | 7/1971 | Rosen . |
| 3,615,292 | 10/1971 | Badin . |

OTHER PUBLICATIONS

L. Dodge and D. Naegeli of the Southwest Research Institute, San Antonio, Texas, "Combustion Characterization of Methylal in Reciprocating Engines," Jun. 1994, NREL/TP–425–6345, DE94 006949.

C. Beatrice, et al, "An experimental characterization of the formation of pollutants in DI diesel engines burning oxygenated synthetic fuels," C517/023/96 IMechE. Date unknown.

Kent B. Spreen, et al, "Effects of Cetane Number, Aromatics, and Oxygenates on Emissions From a 1994 Heavy–Duty Diesel Engine With Exhaust Catalyst," SAE Technical Paper Series, #950250, International Congress & Exposition, Detroit, Michigan, 1995.

L. Dodge et al, "Combustion Characterization of Methylal in Reciprocating Engines" Jun. 1994, MREL/TP–425–6345, DE94 006949.

K. Speen, et al. Effects of Centane No. Aromatics and Oxygenates on Emssions From a 1994 Heavyduty Engine With Exhaust Catalyst, SAE Tech Paper, #950250, International Congress & Expo, Detroit MI, 1995.

*Primary Examiner*—Sharon Gibson
*Assistant Examiner*—Cephia D. Toomer
*Attorney, Agent, or Firm*—Robert J. Wolff

[57] ABSTRACT

A diesel fuel composition is set forth for an increased cetane number vis-a-vis conventional diesel fuel compositions. The composition generally comprises one or more compounds selected from the dialkoxy alkane (DAAK) chemical family. In a preferred embodiment of the present invention, the diesel fuel composition consists of moderate amounts of dimethoxy propane (DMPP) and dimethoxy ethane (DMET) blended into a conventional diesel fuel.

5 Claims, No Drawings

DIESEL FUEL COMPOSITION COMPRISING DIALKOXY ALKANES FOR INCREASED CETANE NUMBER

STATEMENT REGARDING FEDERALLY SPONSORED RESEARCH OR DEVELOPMENT

This invention was made under DOE Contract DE-FC22-95PC93052 and is subject to government rights arising therefrom.

BACKGROUND OF THE INVENTION

The present invention is a diesel fuel composition for an increased cetane number vis-a-vis conventional diesel fuel compositions and generally comprises one or more compounds selected from the dialkoxy alkane (DAAK) chemical family.

A diesel fuel is a broad class of petroleum products which includes distillate or residual materials (or blends of these two) from the refining of crude oil and which is used in compression ignition or diesel engines. The two primary criteria used to define diesel fuel are distillation range (generally between 150° and 380° C. or 302° and 716° F.) and specific gravity range (between 0.760 and 0.935 at 59° F. or 15° C.). The properties of diesel fuel greatly overlap those of kerosene, jet fuels, and burner fuel oils and thus all these products are generally referred to as intermediate distillates.

The cetane number of a diesel fuel is roughly analogous to the octane number of gasoline. A high cetane number indicates the ability of a diesel engine fuel to ignite quickly after being injected into the combustion cylinder.

Prior to reviewing the prior art with regard to diesel fuel compositions comprising DAAKs, it is worth noting some background information on the DAAK chemical family, including alternative nomenclature. DAAKs can be represented as R—O—X—O—R where R=$C_nH_{2n+1}$, O=oxygen and X=$C_mH_{2m}$. Probably the best known compound in this family is dimethoxy methane (DMMT) where n and m in the above formula are equal to 1 and which is more commonly referred to as methylal. Other compounds in this family which are the subject matter of the present invention include dimethoxy ethane (DMET) where n is again equal to 1 but m is equal to 2, and dimethoxy propane (DMPP) where n is again equal to 1 but m is equal to 3. Other common nomenclature for DAAKs is alkylene glycol dialkyl ethers. Similarly, other common nomenclature for DMMT, DMET and DMPP is, respectively, methylene glycol dimethyl ether, ethylene glycol dimethyl ether and (as it relates to 1,2 DMPP) propylene glycol dimethyl ether.

DMMT is taught as a cetane improving additive for diesel fuel. Specifically, a study by Southwest Research Institute for the US Department of Energy (as reported in OSTI as DE94006949, June 1994) teaches that DMMT (referred to as methylal in this study) may have possible use as a diesel fuel additive/replacement because it reduces smoke emissions and because it has a favorable cetane number. A repeat test by Southwest Research Institute on the Applicant's behalf, however, indicates that DMMT has a cetane number of only 29 (as compared to a cetane number of approximately 40 for conventional diesel fuel) and is not a cetane improver when added to diesel fuel.

DMET is taught as a diesel fuel additive in small (less than 5 weight %) concentrations for the purpose of soot and smoke suppression. See for example U.S. Pat. No. 3,594,136, U.S. Pat. No. 3,594,140, U.S. Pat. No. 3,615,292 and GB Patent Specification 1,246,853. DMET was also studied as a possible soot reducing diesel fuel replacement by Beatrice et al. in a 1996 article in IMech E (C517/023/96) where it was noted that DMET has a cetane number of 98. One study by Southwest Research Institute as reported in the SAE Technical Paper Series (950250) also teaches DMET (which was referred to as ethylene glycol dimethyl ether and "monoglyme" in this study) as a diesel fuel additive at moderate concentrations, specifically at concentrations of 5.62 mass % (5.5 volume %) and 11.24 mass % (11.1 volume %). The purpose of adding DMET to diesel duel in this study was not for cetane improvement, however, but for the purpose of increasing the oxygen level of the diesel fuel so that the effect of oxygen level on emission levels could be determined. Although this study also adjusted the cetane number of the diesel fuel so that the effect of cetane number on emission levels could be similarly determined, the cetane improver additive was 2-ethylhexyl nitrate and not DMET. Any cetane improvement attributable to DMET in this study was inadvertent. This study did note that oxygenating the diesel fuel generally increased cetane number in proportion to the amount of DMET added. Applicant's testing, however, indicates that although DMET has a very high cetane number of 105, it is not a significant cetane improver when added to diesel fuel except at concentrations above approximately 25 volume %.

DMPP, and other DAAKs besides DMMT and DMET, are not taught as diesel fuels or additives thereto.

BRIEF SUMMARY OF THE INVENTION

The present invention is a diesel fuel composition for an increased cetane number vis-a-vis conventional diesel fuel compositions and generally comprises one or more compounds selected from the dialkoxy alkane (DAAK) chemical family. In a preferred embodiment of the present invention, the diesel fuel composition consists of moderate amounts of dimethoxy propane (DMPP) and dimethoxy ethane (DMET) blended into a conventional diesel fuel.

DETAILED DESCRIPTION OF THE INVENTION

The present invention is a diesel fuel composition for increased cetane number comprising one or more compounds selected from the group consisting of:

(a) dimethoxy propane (DMPP) as represented by $CH_3$—O—$C_3H_6$—O—$CH_3$;

(b) dimethoxy ethane (DMET) as represented by $CH_3$—O—$C_2H_4$—O—$CH_3$ wherein the concentration of the DMET in said diesel fuel composition is either:

(i) any concentration less than 100 volume % if the DMET is used in combination with DMPP in said diesel fuel composition; or (ii) any concentration greater than or equal to 15 volume % but less than 100 volume % if the DMET is not used in combination with DMPP in said diesel fuel composition; and (c) in addition to DMPP and DMET, other dialkoxy alkanes as represented by R—O—X—O—R where R=$C_nH_{2n+1}$, and X=$C_mH_{2m}$, and where n is at least 1 and m is at least 2.

In a typical embodiment of the present invention, the diesel fuel composition further comprises a conventional diesel fuel consisting of a hydrocarbon distillate having a boiling point between 150° C. and 380° C. (302° F. and 716° F.).

DMPP is the most promising individual compound of the present invention in terms of cetane improvement when blended with a conventional diesel fuel. Table 1 below illustrates that 1,2-DMPP has a cetane number of 109 and, when blended with a conventional diesel fuel having a cetane number of 37 (Data 1a) or 52 (Data 1b), the cetane number of the resulting blend is significantly improved above 35 volume % and slightly improved below 35 volume %. (Applicants used a constant volume combustion apparatus to measure all cetane numbers reported herein).

TABLE 1

| Volume % 1,2-DMPP | Cetane Number |
|---|---|
| (Data 1a) | |
| 0 | 37 |
| 45 | 50 |
| 50 | 58 |
| 75 | 90 |
| 100 | 109 |
| (Data 1b) | |
| 0 | 52 |
| 15 | 56 |
| 25 | 60 |
| 35 | 64 |
| 45 | 71 |
| 75 | 83 |

DMET is a cetane improver when blended with a conventional diesel fuel but only at moderately high to high concentrations. Table 2 below illustrates that 1,2-DMET has a cetane number of 105 and, when blended with a conventional diesel fuel having a cetane number of 37 (Data 2a) or 46 (Data 2b), the cetane number of the resulting blend is significantly improved above 25 volume % and slightly improved below 25 volume %.

TABLE 2

| Volume % 1,2-DMET | Cetane Number |
|---|---|
| (Data 2a) | |
| 0 | 37 |
| 45 | 69 |
| 50 | 71 |
| 75 | 76 |
| 100 | 105 |
| (Data 2b) | |
| 0 | 46 |
| 15 | 47 |
| 25 | 50 |
| 35 | 59 |
| 45 | 79 |

Surprisingly and unexpectedly, the combination of DMPP and DMET is a synergistic cetane improver when blended with a conventional diesel fuel. Table 3 below illustrates that when 12.5 volume % 1,2-DMPP and 12.5 volume % 1,2-DMET are blended with 75 volume % of a conventional diesel fuel, the cetane number of the resulting blend is significantly improved to 51. This is unexpected since this percentage increase is much greater than the sum of the parts increases that could be expected based on the data in Tables 1 and 2.

TABLE 3

| Volume % 1,2-DMPP | Volume % 1,2-DMET | Cetane Number |
|---|---|---|
| 0 | 0 | 39.4 |
| 12.5 | 12.5 | 51 |

DMPP and DMET can be prepared from propylene oxide and ethylene oxide respectively. DMET can also be advantageously prepared by the oxidative coupling of dimethyl ether (DME). The other reaction products when starting with DME include the liquid reaction products methanol and DMMT which, along with the liquid reaction product DMET, can easily be separated from the gaseous reaction products of methane, $C_2$ and $C_3$ hydrocarbons, CO, $CO_2$ and non-reacted DME. The relative concentrations of the three liquid reaction products can be varied depending upon the catalyst type, gas hourly space velocity, reaction temperature, reaction pressure and molar ratio of DME/oxygen feed. In general, these variables should be selected to minimize the amount of methanol and DMMT produced since methanol and DMMT have low cetane numbers of 5 and 29 respectively and since, once produced, are difficult to separate from DMET.

The skilled practitioner will appreciate that to be useful the diesel fuel composition of the present invention must result in one phase. Fortunately, blends of DMPP, DMET and conventional diesel fuel can be varied over a wide range and remain miscible (ie remain in one phase). Blends of DMPP and conventional diesel fuel are miscible at concentrations all the way up to 90 volume % DMPP. Likewise, blends of DMET and conventional diesel fuel are miscible at concentrations all the way up to 90 volume % DMET. It should be noted, however, that when methanol is a component of the diesel fuel composition, two phases generally result when the methanol component is greater than 10 volume % and thus methanol should be kept below this limit. The diesel fuel used in generating this miscibility data was #1 diesel fuel having low sulfur, no dye and not a winter formulation.

In addition to improved cetane number, another benefit of the present invention's diesel fuel compositions vis-a-vis conventional diesel fuel compositions is improved cold starting properties which is a function of the fact that the DAAK compounds of the present invention have an increased volatility vis-a-vis conventional diesel fuel.

Finally, it should be noted that given the overlap in properties between diesel fuel and other intermediate distillate fuels such as kerosene, jet fuels, and burner fuel oils, the DAAK compounds of the present invention may also have utility as replacements or additives for such other intermediate distillate fuels.

We claim:

1. A diesel fuel composition for increased cetane number comprising one or more compounds selected from the group consisting of:

(a) dimethoxy propane (DMPP) as represented by $CH_3—O—C_3H_6—O—CH_3$; and (b) dimethoxy ethane (DMET) as represented by $CH_3—O—C_2H_4—O—CH_3$ wherein the concentration of the DMET in said diesel fuel composition is either:

(i) any concentration less than 100 volume % if the DMET is used in combination with DMPP in said diesel fuel composition; or (ii) any concentration greater than or equal to 25 volume % but less than 100 volume % if the DMET is not used in combination with DMPP in said diesel fuel composition.

2. The diesel fuel composition of claim 1 which further comprises a conventional diesel fuel consisting of a hydrocarbon distillate having a boiling point between 150° C. and 380° C. (302° F. and 716° F.).

3. The diesel fuel composition of claim 2 which consists of 12.5 volume % DMPP, 12.5 volume % DMET and 75 volume % conventional diesel fuel.

4. The diesel fuel composition of claim 2 which further comprises one or more compounds selected from the group consisting of methanol and dimethoxy methane (DMMT) as represented by $CH_3—O—CH_2—O—CH_3$.

5. The diesel fuel composition of claim 4 wherein the compounds comprising DMET, DMMT and methanol are produced as liquid reaction products from the oxidative coupling of dimethyl ether (DME).

* * * * *